US007956476B2

(12) United States Patent
Yang

(10) Patent No.: US 7,956,476 B2
(45) Date of Patent: Jun. 7, 2011

(54) FOOTWEAR ENERGY HARVESTING SYSTEM

(75) Inventor: Wei Yang, Minnetonka, MN (US)

(73) Assignee: Honeywell International Inc., Morristown, NJ (US)

( * ) Notice: Subject to any disclaimer, the term of this patent is extended or adjusted under 35 U.S.C. 154(b) by 879 days.

(21) Appl. No.: 11/869,515

(22) Filed: Oct. 9, 2007

(65) Prior Publication Data

US 2008/0127510 A1 Jun. 5, 2008

Related U.S. Application Data

(60) Provisional application No. 60/872,220, filed on Dec. 1, 2006.

(51) Int. Cl.
*H02P 9/04* (2006.01)

(52) U.S. Cl. ..... 290/1 R; 290/54

(58) Field of Classification Search ..... 290/1 R, 290/1 A, 52, 43, 54; 310/75; 322/1
See application file for complete search history.

(56) References Cited

U.S. PATENT DOCUMENTS 5,167,082 A 12/1992 Chen
5,401,039 A * 3/1995 Wolf ..... 280/11.202
5,495,682 A 3/1996 Chen
5,860,727 A * 1/1999 Chien ..... 362/84
5,918,381 A 7/1999 Landry
6,182,378 B1 2/2001 Sendaula
6,201,314 B1 3/2001 Landry
6,239,501 B1 * 5/2001 Komarechka ..... 290/1 R
6,255,799 B1 * 7/2001 Le et al. ..... 320/107
6,281,594 B1 * 8/2001 Sarich ..... 290/1 R
6,744,145 B2 * 6/2004 Chang ..... 290/1 R
7,005,757 B2 * 2/2006 Pandian ..... 290/1 R
7,327,046 B2 * 2/2008 Biamonte ..... 290/1 R
7,395,614 B1 * 7/2008 Bailey et al. ..... 36/28
7,426,793 B2 * 9/2008 Crary ..... 36/29

* cited by examiner

*Primary Examiner* — Nicholas Ponomarenko
(74) *Attorney, Agent, or Firm* — Seager Tufte & Wickhem LLC

(57) ABSTRACT

A system for harvesting footwear energy. The energy may be in a form of footwear movement which involves a compression and decompression of chambers situated in the footwear. There may be a back chamber in the heel area and a front chamber in the toe area of the footwear. The chambers may be filled with gas which moves in and out upon compression and decompression of the chambers at the heel and toe areas upon the ambulatory motion of a person wearing the footwear. The moving gas may go through a pneumatic rectifier that provides a unidirectional stream of gas to spin a micro-turbine which turns an electrical generator, or operate a pneumatic device.

20 Claims, 4 Drawing Sheets

FOOTWEAR ENERGY HARVESTING SYSTEM

This invention claims the benefit of U.S. Provisional Application No. 60/872,220, filed Dec. 1, 2006. U.S. Provisional Application No. 60/872,220, filed Dec. 1, 2006, is hereby incorporated by reference.

BACKGROUND

The present invention pertains to energy converters, and particularly to a capture and conversion of bodily motion to a form of energy.

SUMMARY

The invention is a system for harvesting footwear energy, storing it, using it in an application, and/or converting it into another type of energy.

DESCRIPTION

Figure 1:
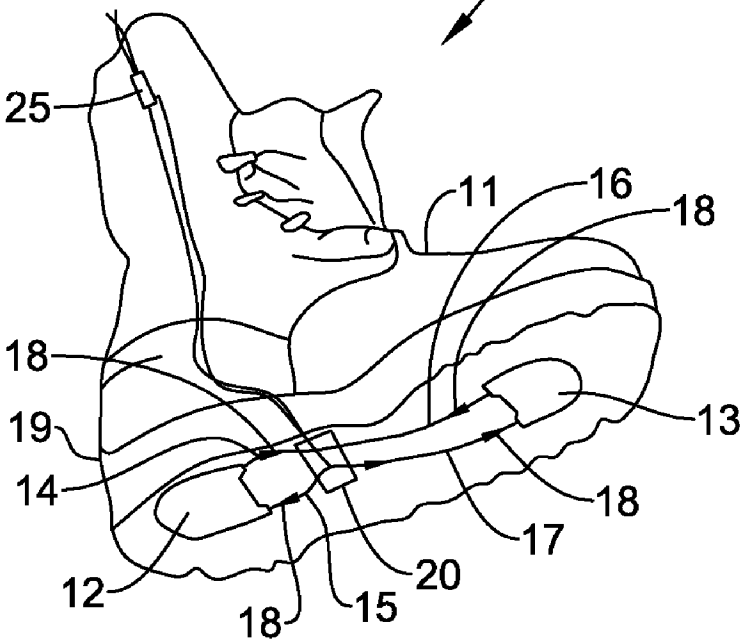
FIG. 1 is a diagram of an energy generating mechanism implementation in footwear.

With increased use of power-consuming portable electronics, the need for compact and lightweight power sources in replacement of batteries appears to be a pressing issue. Energy harvesting from walking, in particular via the force and compression in the footwear soles, has the potential to deliver one to five watts average power with negligible interference with a normal human gait. There appears to be a very significant amount of available "waste" power from normal human activity. However, converting watt-level mechanical body or foot power to usable electricity or other kind of power by a miniature device integratable into body wear such as footwear is approached here in a new way. Many similar existing devices appear cumbersome, inefficient and consequently impractical.

The present invention is a system which may be based on an approach of transmitting the sole-compression pneumatically, for instance, to a high-speed microturbine (or micro turbine), or other pneumatic-to-mechanical converter, which in turn can drive a rotary electromagnetic generator, another energy converter, provide electrical or pneumatic energy to a storage mechanism, and so forth. The pneumatic-to-mechanical converter and the electrical generator in combination may be regarded as a pneumatic-to-electrical converter. The sole or other body wear compression may be transmitted to various energy converters or translators such as a massager or pump (not shown). Sole-compression may be transmitted as a moving fluid in one direction via a pneumatic rectifier to drive a component. An example kind of shoes which may be adapted for the present system may be running or tennis shoes. The term "present" refers to the invention herein. "Fluid" may refer to a gas or liquid.

The component may be a microturbine for driving an electrical generator to provide power to activate a mechanism for use, or a device for electrical storage. The electrical or electronic mechanism may be a cell phone, a PDA (personal digital assistant), a portable computer, body safety or navigation lights, a GPS (global positioning system) device, a warmer for hands, feet, or other portions of the body, various kinds of instrumentation, and so on. In one implementation, a foot warmer may include electrical heating elements formed in socks or built into shoes. A device, such as a chargeable battery or high capacity capacitor, may be provided electrical power by the microturbine-generator for storage. Power may be provided by the generator to both a mechanism and storage. For example, batteries of personal electronic devices may be charged. A common situation may be where some people spend much time on a cell phone while walking around and then frequently have to discontinue their call because of a low battery in the cell phone. With the present system connected to the phone, one could talk indefinitely while walking around to one or more destinations, whether at work or on time off. Whether the phone is being used or not, the cell phone battery may get charged up while walking or running, thus obviating a need to find a source of power, such as an outlet, to plug the phone in for a recharge.

The component may instead be a massager or other similar pneumatically drivable mechanism associated with a person such as the wearer to provide massaging or other physical therapy. The pneumatically powered massager or other mechanism may be in contact with the wearer's body in an applicable place or manner, such as the wearer's feet. Such massaging or therapy, for example, may used to reduce foot and/or leg fatigue of the wearer while walking. The massager or like mechanism may consist of one or more pneumatically inflatable and deflatable bags or pouches proximate to the feet and/or legs of the wearer, and have a pneumatic valve device to alternate filling and releasing a gas, such as air, to and from the pouches.

A pneumatically drivable pump may be connected to the present system and be used for moving fluids for one application or another, such as a pneumatic tool, gas storage under pressure, and so forth.

FIG. 1 is a diagram of an example system 10 of the present invention with a shoe 11 having a sole 19 with compressible chambers 12 and 13. Back chamber 12 at the heel of shoe 11 may have an output 14 and an input 15. When back chamber 12 is compressed, a gas 18 may be expelled through output 14 from chamber 12, particularly when a foot in the shoe 11 is putting weight on the heel of the shoe 11. When weight on the heel is removed, then chamber 12 may decompress and return to its original shape and internal volume. At the same time, gas 18 may return to chamber 12 through the input 15. Also at the same time, the foot in the shoe 11 may be shifting the weight from the heel to the toe and thus compressing chamber 13 and expelling gas 18 through an output 16. When the weight on the toe is removed, the chamber 13 may decompress and return to its original shape and internal volume. At the same time, gas 18 may return to chamber 13 through the input 17. Also at the same time, the foot in the shoe may be shifting the weight from the toe to the heel and again compressing chamber 12 thereby expelling gas 18 through output 14. Such heel-toe or back-front double action may continue to repeat itself indefinitely while a person with the foot is proceeding with an ambulatory motion or some other physical activity. Gas 18 may permit system 10 to operate at various temperatures.

Figure 2A:
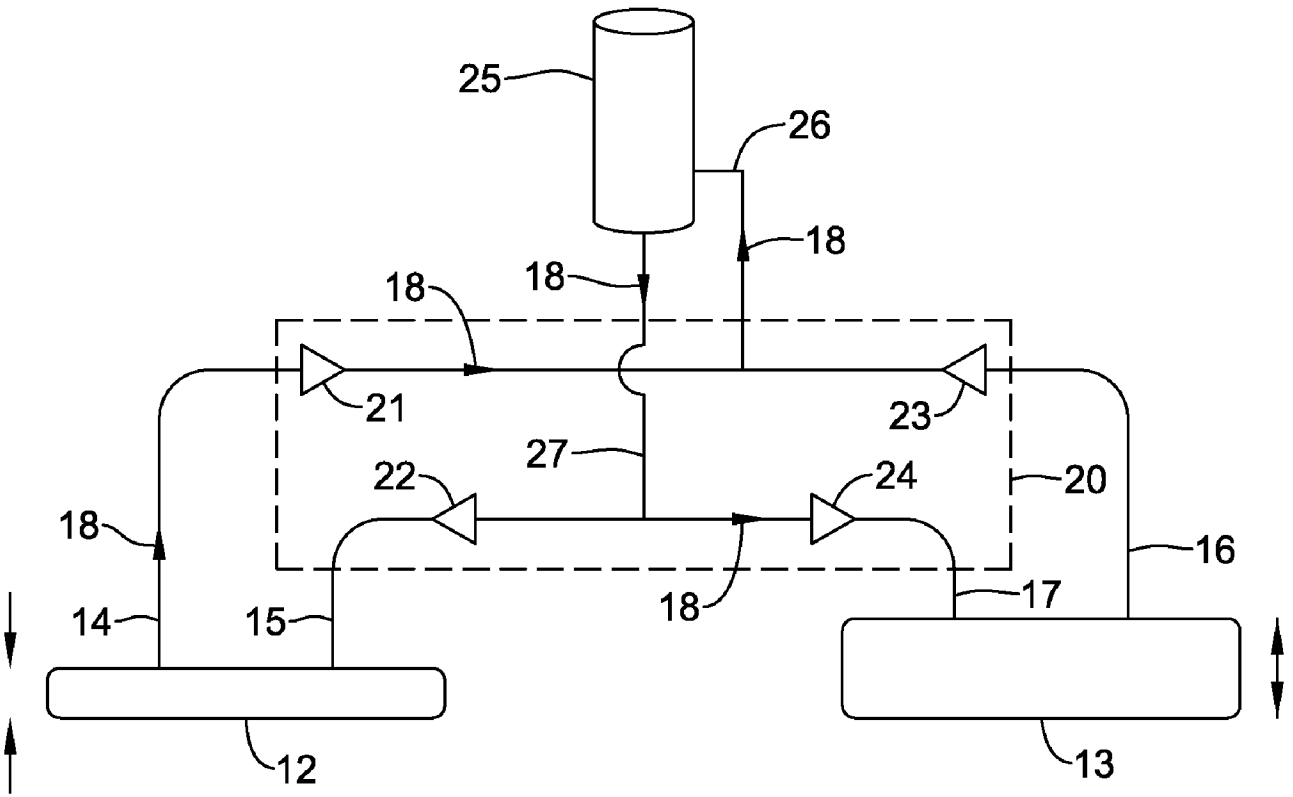
FIGS. 2*a* and 2*b* are diagrams of back-front chambers of the footwear for double action shown in conjunction with a pneumatic rectification circuit and an energy conversion device.
Figure 2B:
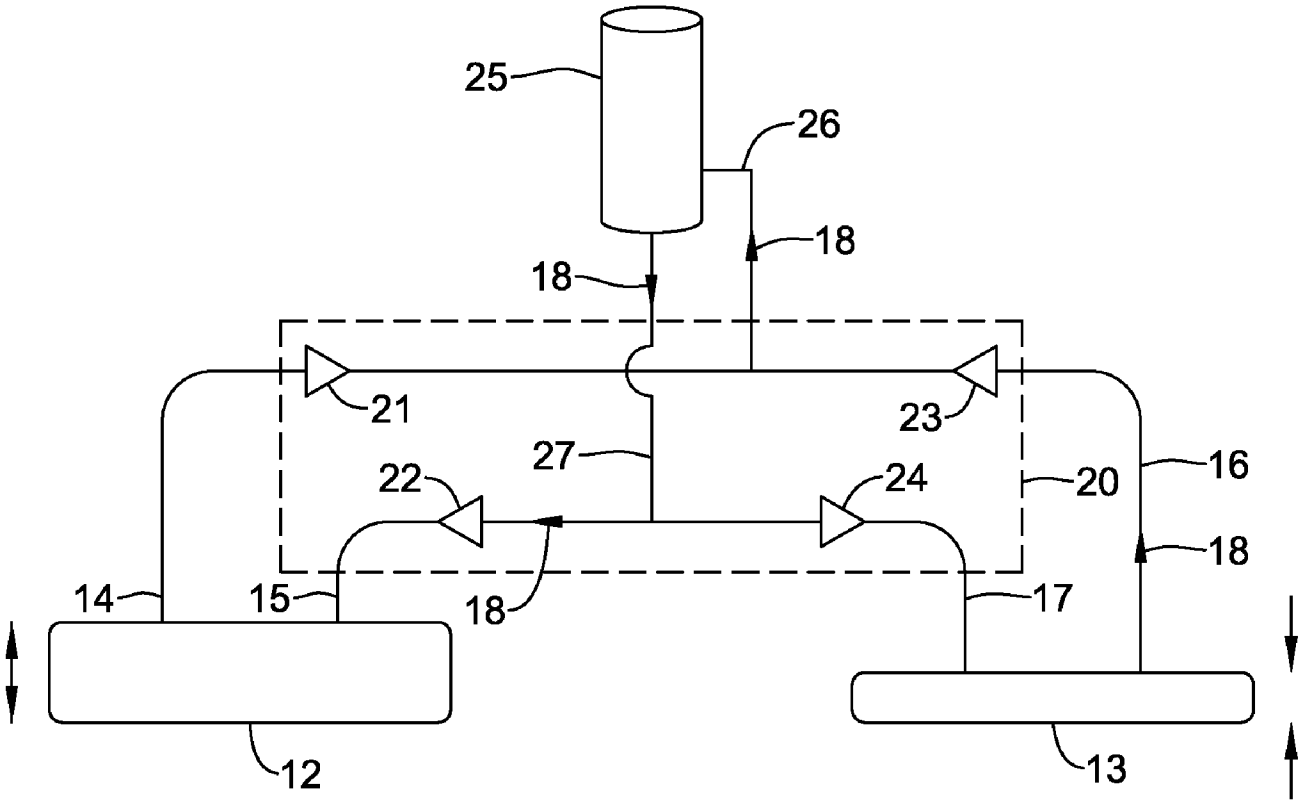

FIGS. 2*a* and 2*b* are diagrams of back-front chambers 12 and 13 for double action shown in conjunction with a pneumatic rectification circuit or rectifier 20 and an energy conversion device 25. The double action may be referred to as front-back, heel-front, front, back, or the like. Chambers 12 and 13 may be embedded insole of shoe 11 and have elastomer walls which facilitate compressibility and decompressibility of the chambers.

When the heel chamber 12 is being compressed, as shown in the diagram of FIG. 2*a*, gas 18 may exit output line 14 and go through a check or one-way valve 21. From valve 21, gas 18 may flow into line or tube 26 to energy converter 25. Gas 18 is not necessarily able to flow through valve 21 towards chamber 12. Converter 25 may instead be an energy storage device or a combination of an energy converter and storage device.

When the heel chamber 12 is being decompressed, as shown in the diagram of FIG. 2*b*, gas 18 may be drawn in from energy converter 25 through line or tube 27 and to a check or one-way valve 22 and enter input line 15 to expanding chamber 12. Gas 18 is not necessarily able to flow through valve 22 away from chamber 12.

When the toe chamber 13 is being decompressed, as shown in the diagram of FIG. 2*a*, gas 18 may be drawn in from energy converter 25 through line or tube 27 and a check or one-way valve 24 and enter input line 17 to expanding chamber 13. Gas 18 is not necessarily able to flow through valve 24 away from chamber 13.

When the toe chamber 13 is being compressed, as shown in the diagram of FIG. 2*b*, gas 18 may exit output line 16 and go through a check or one-way valve 23. From valve 23, gas 18 may flow into line or tube 26 to converter 25. Gas 18 is not necessarily able to flow through valve 23 towards chamber 13.

Figure 3:
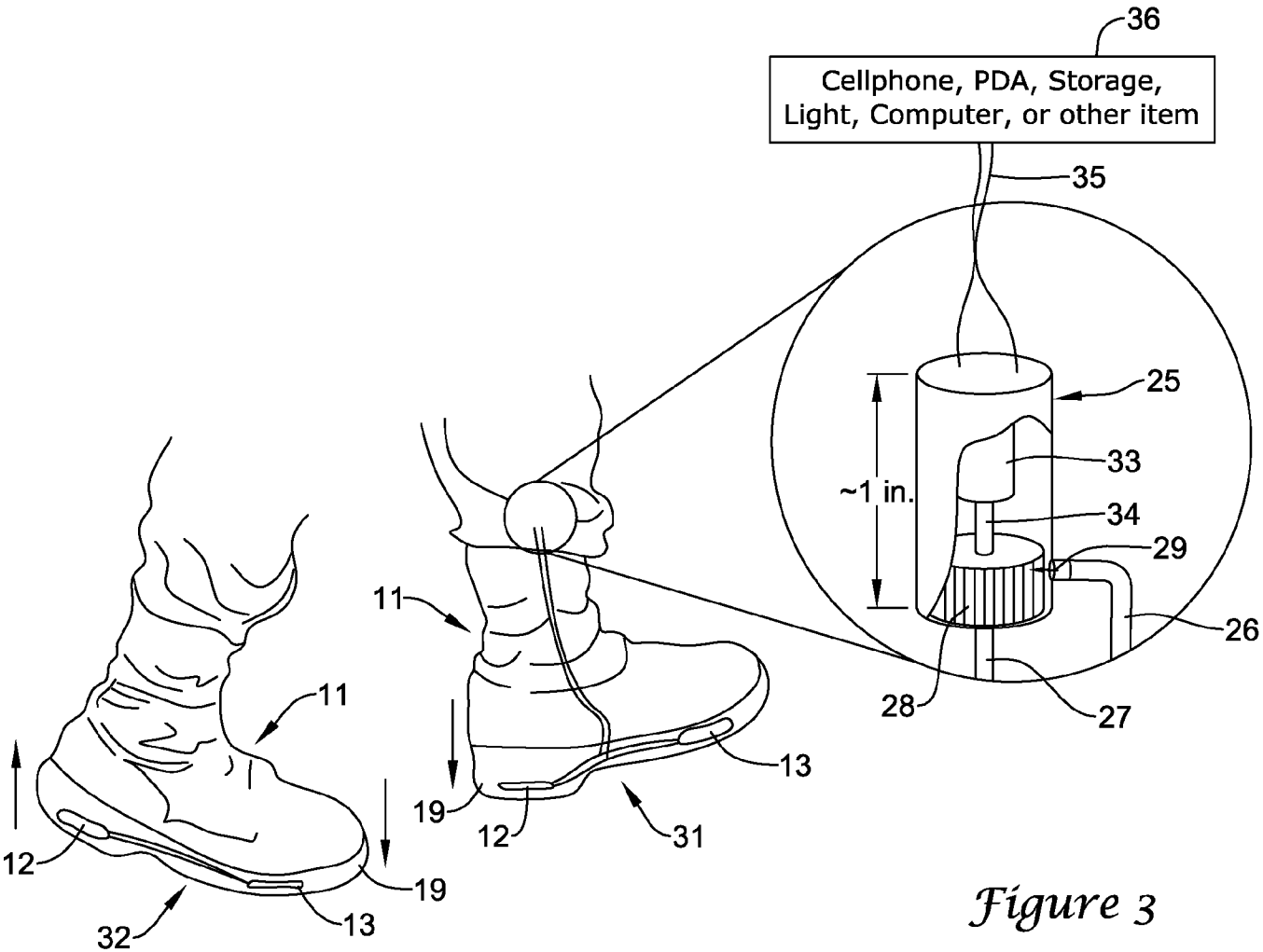
FIG. 3 is a diagram of footwear in action with a cut-away illustration of the energy conversion device.

FIG. 3 show the present system implemented in footwear. Even though two pieces of footwear are shown in the Figure, in some cases the system may be implemented in just one piece of footwear or only one shoe 11 per person. The present system might even be implemented with just one chamber. The system may be implemented in footwear for a kind of animal such as a horse.

In a typical walking step, the gas chamber 12 on the back (heel) may first be compressed during heel landing 31 as indicated in FIG. 3, and then the front chamber 13 may be compressed during the takeoff push 32. The force in both compressions is comparable to the body weight, and their duration may be about 0.5 to 1 second, depending on the walking speed. The peak pressure for a 72 kg (~159 lbs) body weight and a 3×3 $cm^2$ (~1.4 $in^2$) compression area, may be about 784,500 Pa (~114 psi). For a compression distance of 3 mm (0.118 in), the volume displacement may be 2.7 $cm^3$ (~0.165 $in^3$), corresponding to 2.1 J (2.1 watt sec) per compression and 4.2 J (4.2 watt sec) per step. From this estimate, 1 W (1 J/sec) average power at normal walking (2 steps/sec) only needs a minimum conversion efficiency of 12 percent, which is a moderate goal.

The pneumatic rectification circuit 20 using four check valves 21, 22, 23 and 24 may direct the high pressure gas to a turbine 28 with a nozzle 29 for both compressions, so the turbine 28 is always driven in one direction. The turbine 28 may be connected to an electric generator 33 with a shaft 34. Electric current may be provided by leads 35 from the generator 33. The leads 35 may be connected to an electrical device 36 such as a cell phone, a PDA, storage, a computer, a light, or other item.

The microturbine generator unit 25, by virtue of its small size (i.e., about 1 inch in length and 0.5 inch or so in diameter), may be placed in various locations in the footwear 11, depending on overall requirements and other specifications. If the unit 25 is not in sole 19, a pneumatic connection may be made via small tubings 26 and 27 to other locations for unit 25. There may be other items (e.g., a pump for filling a pressure tank with another medium for reserve energy, a massager, pump, and so forth) which may be driven by pressured gas 18 from the footwear 11.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. A footwear energy harvesting system comprising:
- a first chamber situated in footwear;
- a second chamber situated in the footwear;
- a pneumatic rectifier connected to the first and second chambers; and
- a pneumatically drivable energy converter connected to an output of the pneumatic rectifier; and
- wherein the first and second chambers are compressible and contain a gas, and the energy converter is driven by motion of the gas.

2. The system of claim 1, wherein the pneumatic rectifier comprises:
- a first valve having an input connected to an output of the first chamber and having an output;
- a second valve having an output connected to an input port of the first chamber and having an input;
- a third valve having an input connected to an output of the second chamber, and having an output; and
- a fourth valve having an output connected to an input port of the second chamber, and having an input; and
- wherein each valve permits flow only from the input to the output of the valve.

3. The system of claim 2, wherein:
- the energy converter has an input connected to the outputs of the first and third pneumatic valves; and
- the energy converter has an output connected to the inputs of the second and fourth pneumatic valves.

4. The system of claim 1, wherein the energy converter is a pneumatic-to-electrical converter.

5. The system of claim 4, wherein pneumatic-to-electrical converter is connected to an electronic mechanism such as a cell telephone, a PDA, a portable computer, storage, a GPS device, body safety or navigation lights, instrumentation, or the like.

6. The system of claim 3, wherein the energy converter is a pneumatically drivable pump or a pneumatically drivable massager.

7. The system of claim 3, wherein an ambulatory movement of the footwear causes a pressure differential between the inputs and outputs of the first and second chambers to result in a flow through the energy converter via the input and the output of the converter.

8. The system of claim 1, wherein the first and second chambers, the pneumatic rectifier, and the pneumatically drivable energy converter are pneumatically interconnected via a pneumatic path not open to the ambient atmosphere during operation.

9. The system of claim 1, further comprising:
- a pneumatically drivable pump connected to the first chamber, the second chamber, the pneumatic rectifier, and pneumatically drivable energy converter; and
- a gas storage device connected to the pneumatically drivable pump;

wherein the pneumatically drivable pump moves gas to the gas storage device for storage under pressure.

10. A footwear energy harvesting system comprising:

a first compressible chamber situated in or proximal a sole of an article of footwear, the first compressible chamber including a first input tube and a first output tube;

a second compressible chamber situated in or proximal the sole of the article of footwear, the second compressible chamber including a second input tube and a second output tube;

a pneumatic rectifier connected to the first input tube, the second input tube, the first output tube, and the second output tube, wherein the pneumatic rectifier permits flow from the first output tube and the second output tube to a pneumatic rectifier output, but substantially not reverses of these flows, and wherein the pneumatic rectifier permits flow from a pneumatic rectifier input to the first input tube and the second input tube, but substantially not reverses of these flows; and a pneumatically drivable energy converter connected to the pneumatic rectifier output and the pneumatic rectifier input; and wherein the first and second compressible chambers, the pneumatic rectifier, the pneumatically driven energy converter, and interconnecting tubes contain a fluid, and the energy converter is driven by motion of the fluid induced as the first and second compressible chambers are compressed and expanded during walking of a wearer of the article of footwear.

11. The system of claim 10, wherein the pneumatic rectifier comprises:

a first output valve connected to the first output tube;

a second output valve connected to the second output tube;

a first input valve connected to the first input tube; and a second input valve connected to the second input tube;

wherein each valve is a one-way valve.

12. The system of claim 10, wherein the fluid is a gas.

13. The system of claim 10, wherein the pneumatically drivable energy converter is located not in the sole of the article of footwear.

14. The system of claim 13, wherein the pneumatically drivable energy converter is located substantially above the sole of the article of footwear.

15. A footwear energy harvesting system comprising:

a first chamber situated in or proximal a sole of an article of footwear;

a second chamber situated in or proximal the sole of the article of footwear;

a pneumatic rectifier connected to the first and second chambers and having an output and an input; and a pneumatically drivable energy converter connected to the output and the input of the pneumatic rectifier, the pneumatically drivable energy converter being disposed at a location in or proximal the article of footwear substantially above the sole of the article of footwear; and wherein the first and second chambers are compressible and contain a fluid, and the energy converter is driven by motion of the fluid.

16. The system of claim 15, wherein the fluid is a gas.

17. The system of claim 15, wherein the fluid is a liquid.

18. The system of claim 15, wherein the energy converter converts motion of the fluid to electrical energy.

19. The system of claim 15, wherein the pneumatically drivable energy converter is located above the height of an ankle of a wearer of the article of footwear.

20. The system of claim 15, wherein the pneumatically drivable energy converter is located in or on an upper portion of the article of footwear.

* * * * *